US011823565B2

(12) United States Patent
Shivarkar

(10) Patent No.: US 11,823,565 B2
(45) Date of Patent: Nov. 21, 2023

(54) SYSTEM AND METHOD FOR VEHICLE QUEUE LENGTH DETECTION IN A CONNECTED VEHICLE INFRASTRUCTURE ENVIRONMENT

(71) Applicant: Yunex LLC, Wilmington, DE (US)

(72) Inventor: Pratik Shivarkar, Austin, TX (US)

(73) Assignee: YUNEX LLC, Wilmington, DE (US)

( * ) Notice: Subject to any disclaimer, the term of this patent is extended or adjusted under 35 U.S.C. 154(b) by 113 days.

(21) Appl. No.: 17/126,357

(22) Filed: Dec. 18, 2020

(65) Prior Publication Data

US 2022/0198920 A1 Jun. 23, 2022

(51) Int. Cl.

| | |
|---|---|
| ***G08G 1/01*** | (2006.01) |
| ***G08G 1/08*** | (2006.01) |
| ***G08G 1/0967*** | (2006.01) |

(52) U.S. Cl.

CPC ..... *G08G 1/0112* (2013.01); *G08G 1/0125* (2013.01); *G08G 1/0145* (2013.01); *G08G 1/08* (2013.01); *G08G 1/0967* (2013.01)

(58) Field of Classification Search

CPC ..... G08G 1/096775; G08G 1/096716; G08G 1/096741; G08G 1/0133; G08G 1/01; G08G 1/0112; G08G 1/0141; G08G 1/096827; G08G 1/20; G08G 1/00; G08G 1/0104; G08G 1/012; G08G 1/0125; G08G 1/04; G08G 1/09675; G08G 1/0968; G08G 1/096811; G08G 1/096838; G08G 1/096866; G08G 1/096872; G08G 1/096883; G08G 1/0969; G08G 1/127; G08G 5/00; G08G 5/0091; G01C 21/3694;

(Continued)

(56) References Cited

U.S. PATENT DOCUMENTS

2013/0154853 A1* 6/2013 Chen ..... G08G 1/096783 340/905
2016/0086285 A1* 3/2016 Jordan Peters .. G08G 1/096827 701/484

(Continued)

FOREIGN PATENT DOCUMENTS

JP 2011068308 A * 4/2011
JP 2011068308 A * 4/2011

*Primary Examiner* — Jonathan M Dager
*Assistant Examiner* — Aarron E Santos
(74) *Attorney, Agent, or Firm* — Laurence A. Greenberg; Werner H. Stemer; Ralph E. Locher

(57) ABSTRACT

A system for determining a vehicle queue length in a connected vehicle infrastructure environment includes a vehicle traffic data evaluation module with a processor configured via executable instructions to receive vehicle traffic data of multiple vehicles, the vehicle traffic data comprising basic safety messages, create a geometric representation of a vehicle queue, the vehicle queue comprising one or more segments, each segment comprising a set length, extract data of speed, location, date and time from the basic safety messages, aggregate extracted data with the geometric representation of the vehicle queue, assign a speed value of a basic safety message of a vehicle to a segment when the vehicle is identified to be located within the segment of the vehicle queue, detect a sequence of segments comprising assigned speed values, and determine a vehicle queue length based on the set length of each segment.

20 Claims, 4 Drawing Sheets

(58) Field of Classification Search
CPC ..... G01C 21/3691; G01C 21/32; G01C 21/3415; G01C 21/3423; G01C 21/3453; G01C 21/3492; G01C 21/3647; G01C 21/3667; G01C 21/3676; G01C 21/3697
See application file for complete search history.

(56) References Cited

U.S. PATENT DOCUMENTS

| | | | | |
|---|---|---|---|---|
| 2019/0176833 | A1* | 6/2019 | Ekonen | B60W 30/18172 |
| 2020/0175855 | A1* | 6/2020 | Park | G08G 1/096827 |
| 2021/0049373 | A1* | 2/2021 | Vladimerou | G06V 20/56 |
| 2021/0375129 | A1* | 12/2021 | Meng | G08G 1/095 |

* cited by examiner

SYSTEM AND METHOD FOR VEHICLE QUEUE LENGTH DETECTION IN A CONNECTED VEHICLE INFRASTRUCTURE ENVIRONMENT

BACKGROUND

1. Field

Aspects of the present disclosure generally relate to traffic management and traffic monitoring, specifically to systems and methods for detecting vehicle queue lengths in a connected vehicle infrastructure environment.

2. Description of the Related Art

In general, traffic management and monitoring systems collect and/or process traffic related data and information. Collected and/or processed data and information may be utilized for reasons related to safety, efficiency, environmental concerns, and other issues, such as for example for detecting vehicle queue length(s). As vehicles exit an Expressway or Highway, right-turn lane(s) may back up due to local congestion, causing a queue to back up onto the Expressway or Highway. As vehicles approach the exit, they may not be able to anticipate where the end of the queue is, potentially causing them to hard brake, attempt a rapid lane change or crash.

SUMMARY

Briefly described, aspects of the present disclosure relate to a system and a method for detecting vehicle queue lengths in a connected vehicle infrastructure environment.

A first aspect of the present disclosure provides a system for determining a vehicle queue length in a connected vehicle infrastructure environment comprising a vehicle traffic data evaluation module comprising at least one processor configured via executable instructions to receive vehicle traffic data of multiple vehicles, the vehicle traffic data comprising basic safety messages, create a geometric representation of a vehicle queue, the vehicle queue comprising one or more segments, each segment comprising a set length, extract data of speed, location, date and time from the basic safety messages, aggregate extracted data with the geometric representation of the vehicle queue, assign a speed value of a basic safety message of a vehicle to a segment when the vehicle is identified to be located within the segment of the vehicle queue, detect a sequence of segments comprising assigned speed values, and determine a vehicle queue length based on the set length of each segment.

A second aspect of the present disclosure provides a method for determining a vehicle queue length in a connected vehicle infrastructure environment comprising, through operation of at least one processor, receiving vehicle traffic data of multiple vehicles, the vehicle traffic data comprising basic safety messages, creating a geometric representation of a vehicle queue, the vehicle queue comprising one or more segments, each segment comprising a set length, extracting data of speed, location, date and time from the basic safety messages, aggregating extracted data with the geometric representation of the vehicle queue, assigning a speed value of a basic safety message of a vehicle to a segment when the vehicle is identified to be located within the segment of the vehicle queue, detecting a sequence of segments comprising assigned speed values, and determining a vehicle queue length based on the set length of each segment.

A third aspect of the present disclosure provides a non-transitory computer readable medium encoded with processor executable instructions that when executed by at least one processor, cause the at least one processor to carry out a method for determining a vehicle queue length in a connected vehicle infrastructure environment as described herein.

DETAILED DESCRIPTION

To facilitate an understanding of embodiments, principles, and features of the present disclosure, they are explained hereinafter with reference to implementation in illustrative embodiments. In particular, they are described in the context of being systems and methods for detecting and determining vehicle queue lengths in a connected vehicle infrastructure environment. Embodiments of the present disclosure, however, are not limited to use in the described systems, devices or methods.

The present disclosure relates to finding new uses for connected vehicle data, provided by onboard units installed within vehicles, wherein roadside units retrieve and store standardized data and information from the onboard units of the vehicles.

Figure 1:
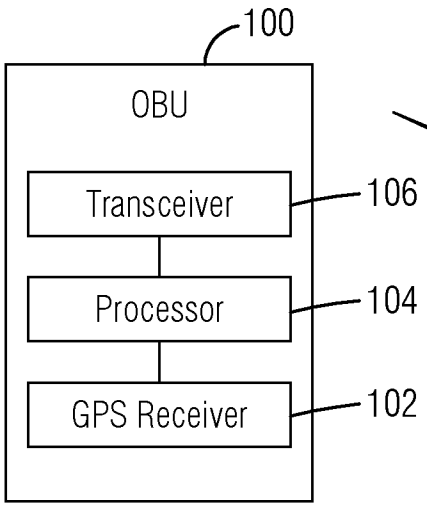
FIG. 1 illustrates a simplified block diagram of an onboard unit of a vehicle in accordance with an exemplary embodiment of the present disclosure.

FIG. 1 illustrates a simplified block diagram of an onboard unit 100, herein also referred to OBU 100, of a vehicle in accordance with an exemplary embodiment of the present disclosure. A vehicle includes many types of motor vehicles that travel within a road network, such as cars, trucks, buses etc. The onboard unit 100 is installed in the vehicle and comprises processor 104 connected between a Global Positioning System (GPS) receiver 102 and a transceiver 106. The processor 104 receives geographic location of the GPS receiver 102 and precise time of day, updated continually or periodically. The GPS receiver 102 receives the geographic location and time from the GPS. The GPS is well known and will not be described herein in detail.

Further data, such as vehicle identification data and vehicle speed data can be recorded by the onboard unit 100. The processor 104 transmits at least the location data, time data and speed data to the transceiver 106, which transmits the location, time and speed data wirelessly to a roadside unit 200 (see FIG. 2). In this manner, the roadside unit 200 receives continuous updates of the geographic location at a precise time and speed for every vehicle approaching from each direction that is within the broadcast area of the respective transceivers 106.

Those of skill in the art will recognize that not all details are shown in the simplified diagram of FIG. 1. For example, GPS receiver 102 may also be connected to an automobile navigation system, an emergency-communication system, or to other components of the automobile. The GPS receiver 102, processor 104, and transceiver 106 may each also be connected to a vehicle power source and/or to other systems and components of the vehicle. The processor 104, and other components, can be configured to read and write to a storage such as volatile and non-volatile memory, magnetic, optical, or solid-state media, or other storage devices. Processor 104 may be configured to perform only the processes described herein or can also be configured to perform other processes for the operation and management the vehicle. The various components of FIG. 1 may be constructed as separate elements configured to communicate with each other, or two or more of these components may be integrated into a single device.

Figure 2:
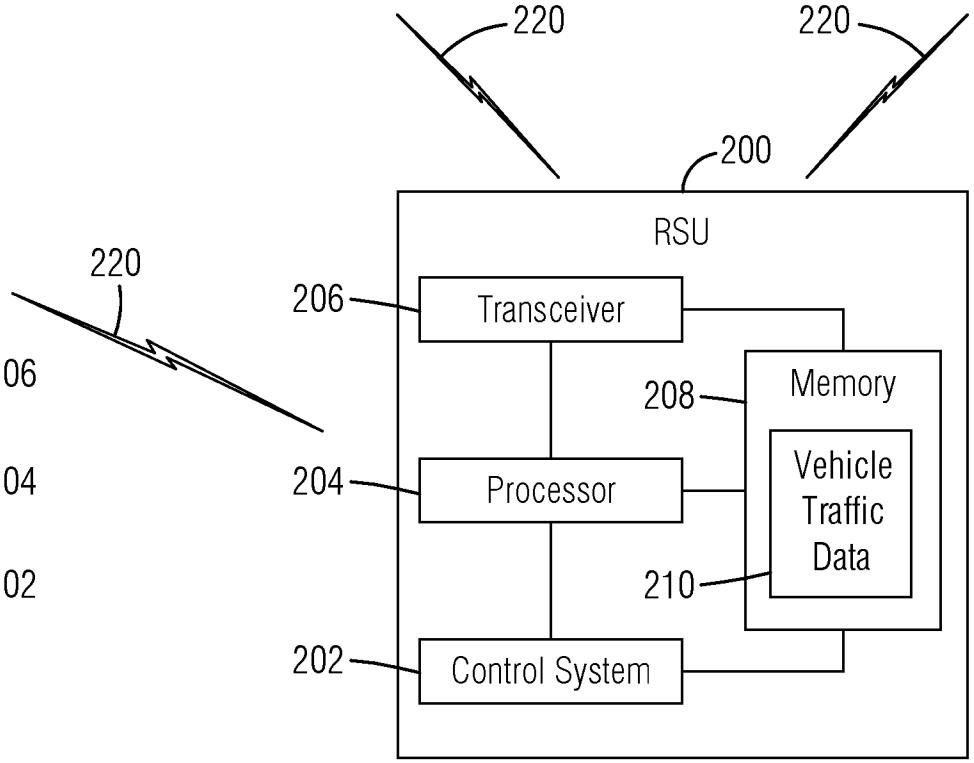
FIG. 2 illustrates a simplified block diagram of a roadside unit in accordance with an exemplary embodiment of the present disclosure.

FIG. 2 illustrates a simplified block diagram of a roadside unit 200, herein also referred to RSU 200, in accordance with an exemplary embodiment of the present disclosure. Processor 204 of RSU 200 is connected between a control system 202 and a transceiver 206. The transceiver 206 receives data and information from multiple transceivers 106 of multiple OBUs 100, including for example location data, time data, speed data and/or vehicle identification data etc. of multiple uniquely-identified vehicles, updated continually or periodically, illustrated via elements 220. The received data and information are herein referred to as vehicle traffic data 210. As FIG. 2 shows, the RSU 200 may receive vehicle traffic data from multiple OBUs 100 of multiple vehicles.

The transceiver 206 provides received vehicle traffic data 210 to the processor 204, and the processor 204 then sends the vehicle traffic data 210 to the control system 202. The control system 202 may analyze or process and utilize the vehicle traffic data 210 for example for traffic control and management processes. Further, the RSU 200 comprises at least one memory 208, volatile or non-volatile, for storing the vehicle traffic data 210 received from the OBUs 100 of the multiple vehicles. The processor 204 is configured to read and write to the memory 208, wherein the vehicle traffic data 210 including location data, time data, speed data and other data provided by OBUs 100 are stored in the memory 208.

Those of skill in the art will recognize that not all details are shown in the simplified diagram of FIG. 2. For example, control system 202, processor 204, and transceiver 206 are each also connected to a power source and may each be connected to other systems and components. The processor 204 may be configured to perform only the processes described herein or can also be configured to perform other processes for the operation and management the RSU 200. The various components of FIG. 2 can be constructed as separate elements configured to communicate with each other, or two or more of these components could be integrated into a single device. For example, processor 204 can be an integral part of the control system 202 and perform many or all the functions of the RSU 200.

In an embodiment, wireless transmission between OBUs 100 and RSUs 200 can be performed via dedicated short-range communications (DSRC). Further, multiple OBUs 100 may communicate with each other, i.e. with other OBUs 100, via DSRC, and multiple RSUs 200 may communicate with each other, i.e. with other RSUs 200, via DRSC. In other embodiments, the OBUs 100 and RSUs 200 may communicate via a wireless communication link, such as for example wireless LAN (over Internet access point), cellular/mobile network(s) or other radio technology, such as for example via cellular V2X or via standard LTE (3G/4G/5G).

Some or all the components of the RSU 200 can be physically located other than "roadside", such as in a traffic cabinet, traffic controller, signal head, or otherwise. The RSU 200 can be used to control many different types of traffic equipment and can be used to collect and send data to a central monitoring station for further analysis or action, using common networking and communication techniques.

Figure 3:
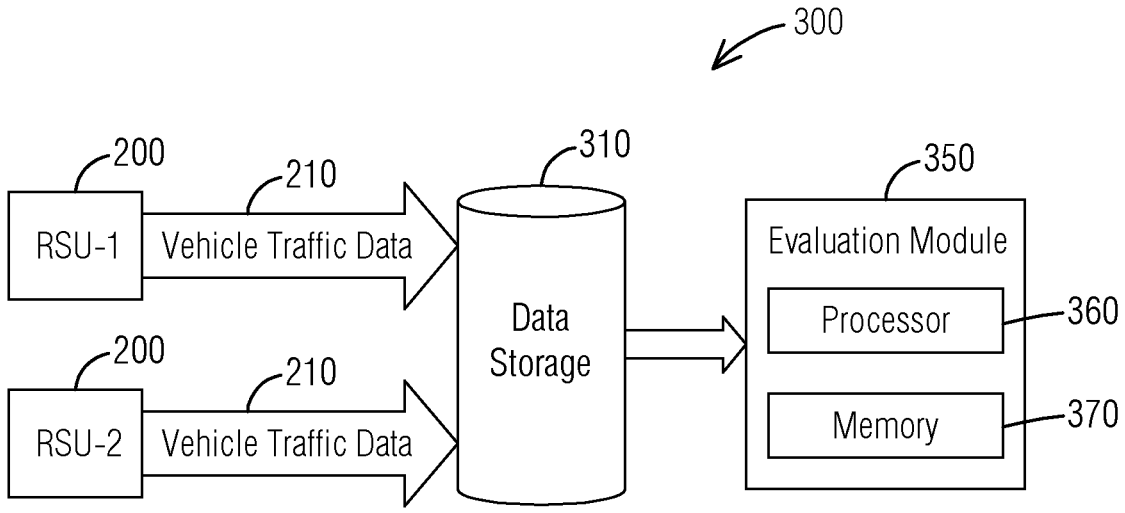
FIG. 3 illustrates a schematic diagram of a system for determining a vehicle queue length in a connected vehicle infrastructure environment in accordance with an exemplary embodiment of the present disclosure.

FIG. 3 illustrates a schematic diagram of a system 300 for detecting and/or determining vehicle queue lengths in a connected vehicle infrastructure environment in accordance with an exemplary embodiment of the present disclosure. Generally, the system 300 utilizes vehicle traffic data 210 of multiple roadside units 200, such as RSU-1 and RSU-2, wherein the roadside units RSU-1 and RSU-2 can be configured for example as described with reference to FIG. 2.

System 300 comprises vehicle traffic data evaluation module 350, herein also referred to as evaluation module 350, comprising at least one processor 360 and a memory 370, wherein the vehicle traffic data evaluation module 350 is configured to receive, process and evaluate or analyze vehicle traffic data 210 provided by RSU-1 and RSU-2. Although system 300 illustrates only two RSUs 200, the vehicle traffic data evaluation module 350 may receive or collect and process data from many RSUs 200.

In exemplary embodiments, the memory 370 may include any of a wide variety of memory devices including volatile and non-volatile memory devices, and the at least one processor 360 may include one or more processing units.

The vehicle traffic data evaluation module 350 may be embodied as software or a combination of software and hardware. The vehicle traffic evaluation module 350 may be a separate module or may be an existing module programmed to perform a method as described herein. For example, the vehicle traffic data evaluation module 350 may be incorporated, for example programmed, into an existing traffic management or monitoring device, by means of software.

The memory 370 of the evaluation module 350 includes software with a variety of applications. One of the applications includes a method for detecting and/or determining a vehicle queue length in a connected vehicle infrastructure environment. For this application, the at least one processor 360 of the evaluation module 350 is configured, via executable instructions, to collect or receive and process and analyze vehicle traffic data 210 and detect and output a vehicle queue length as described herein. Of course, the at least one processor 360 may be configured to perform only the process(es) described herein or can also be configured to perform other processes.

In general, the evaluation module 350 with the at least one processor 360 is configured to receive collected vehicle traffic data 210 from the plurality of roadside units 200. In an embodiment, the system 300 with the evaluation module 350 is configured to receive or collect the vehicle traffic data from the plurality of roadside units 200 in real time and detect or determine the vehicle queue length in real time. In this scenario, the vehicle traffic data 210 may be directly supplied to the evaluation module 350 (without data storage 310 in between) for analysis.

In another embodiment, shown in FIG. 3, the system 300 with the evaluation module 350 is configured to receive/collect the vehicle traffic data from a storage medium, such as data storage 310, and to detect or determine the vehicle queue length on demand (not in real time). For example, a vehicle queue length detection/determination analysis may be performed at any time for analytical purposes, for example to determine at what times of a day/week/month/year specific vehicle queues form and cause congestions or other traffic issues. The data storage 310 storing the vehicle traffic data 210 may be a computer server, for example a remote computer server, or a cloud based data store, or another suitable type of storage.

Figure 4A:
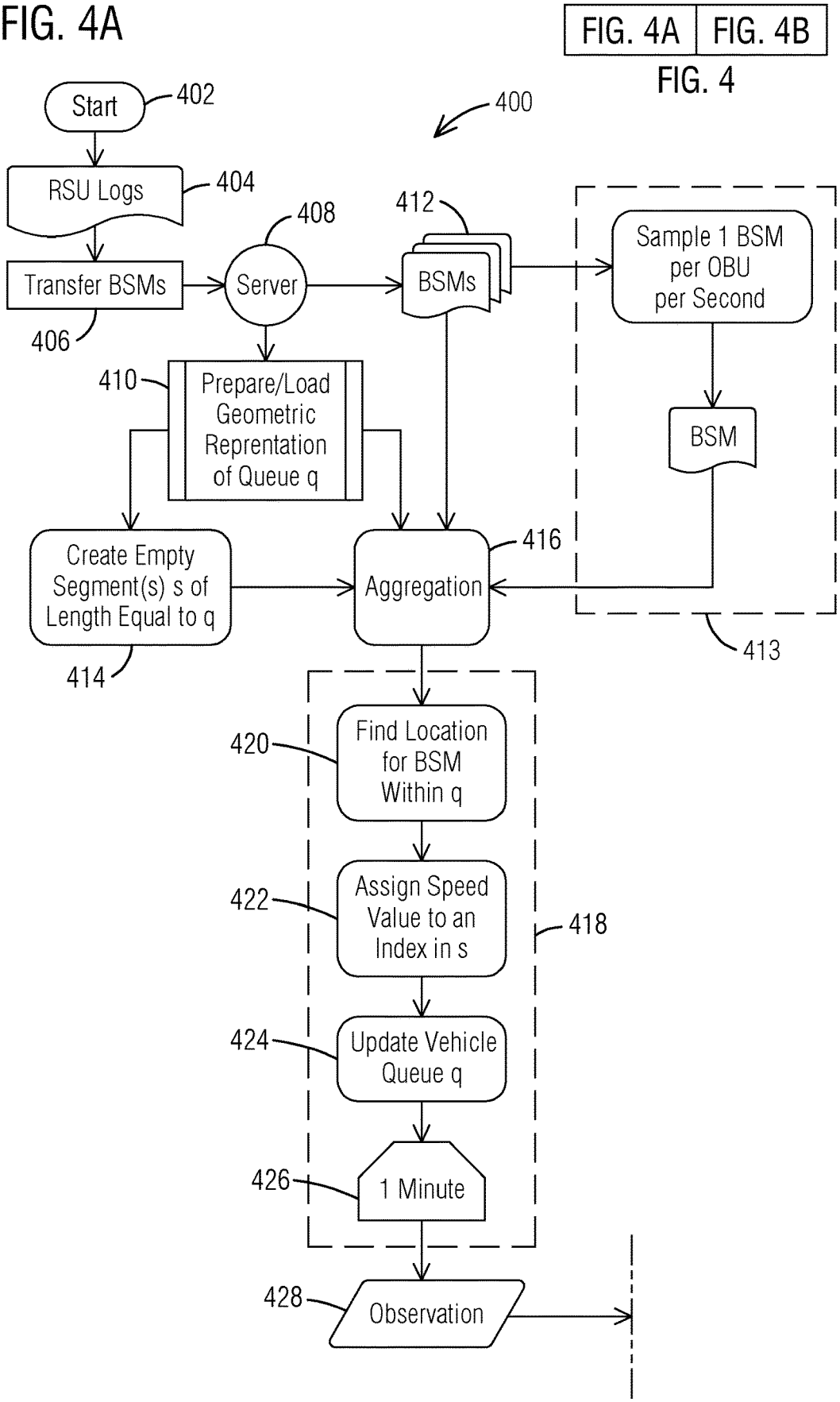
FIG. 4A and FIG. 4B illustrate a flow chart of a method for determining a vehicle queue length within a connected vehicle infrastructure environment in accordance with an exemplary embodiment of the present disclosure.
Figure 4B:
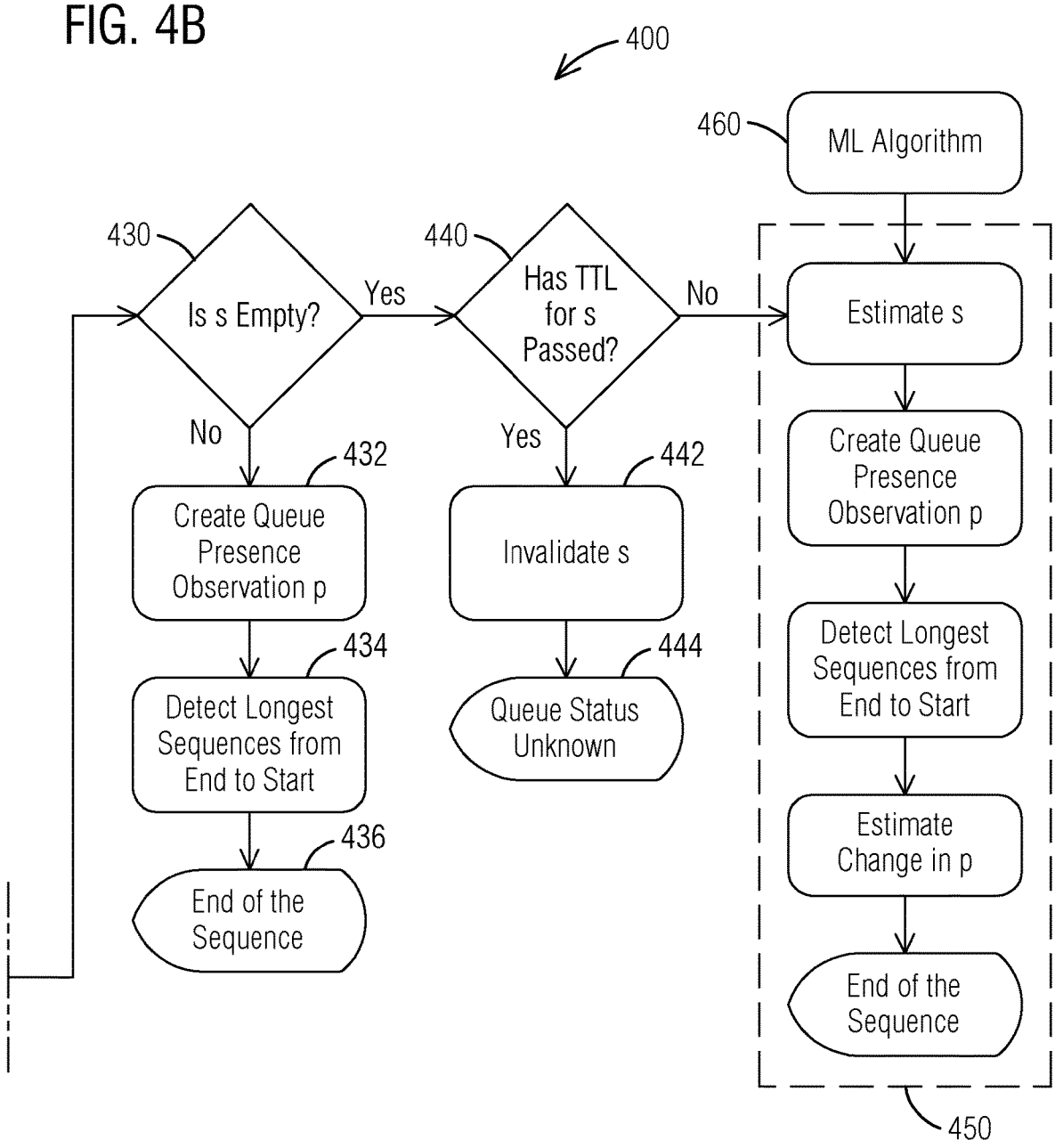

FIG. 4A and FIG. 4B illustrate a flow chart of a method 400 for detecting or determining a vehicle queue length within a connected vehicle infrastructure environment in accordance with an exemplary embodiment of the present disclosure. While the method 400 is described as a series of acts that are performed in a sequence, it is to be understood that the method 400 may not be limited by the order of the sequence. For instance, unless stated otherwise, some acts may occur in a different order than what is described herein. In addition, in some cases, an act may occur concurrently with another act. Furthermore, in some instances, not all acts may be required to implement a methodology described herein.

The method may start at 402. The roadside units 200 (RSU-1, RSU-2), see for example FIG. 2, comprise roadside unit logs, herein referred to as RSU logs 404. The RSU logs 404 can be stored in the roadside units 200 or another external storage medium (for example data storage 310 as illustrated in FIG. 3). The RSU logs 404 comprise, amongst other information, basic safety messages, herein referred to as BSMs 412. A basic safety message (BSM) is a standardized message set specified by the Society of Automotive Engineers (SAE) standards including a standardized set of data. The BSM standard is specified in SAE J2735. Each BSM 412 includes data and information, including for example data of GPS location, speed, date/time of the respective vehicle that recorded these data in its OBU 100 (see FIG. 1). In an example, an OBU 100 may generate and transmit about 10 BSMs per second, for example to an RSU 200. Considering the amount of about 10 BSMs per second and per vehicle, the RSU 200 collects a large amount of data (RSU logs) and in turn the evaluation module 350 may process and evaluate large amounts of data.

The method 400 may include an act or process 406 of extracting data from the RSU logs 404. Specifically, act 406 comprises extracting and transferring the basic safety messages 412 from the RSU logs 404. The extracted BSMs 412 are transferred or provided to computer server 408 or to another type of storage medium, for example a cloud based data store (see also data storage 310 in FIG. 3). The evaluation module 350 utilizes the BSMs 412, or at least certain data of the BSMs 412, for processing and evaluating. The BSMs 412 may be extracted and transferred in an automated manner, for example periodically. In another embodiment, the BSMs 412 or the RSU logs 404 may be transferred manually to the computer server 408.

In act 410, a geometric representation of a vehicle queue q is created, for example prepared or loaded. A vehicle queue q as used herein includes a line or sequence or multiple vehicles. At this stage, the vehicle queue q may be considered an expected or potential vehicle queue q, for example expected to form at exit ramps of Highways or Expressways. For example, an objective is to detect or find out whether a vehicle queue q will or has formed at a specific exit ramp of a Highway. Thus, this specific location can be monitored and a geometric representation of the vehicle queue q at this exit ramp created or loaded.

In act 414, the represented vehicle queue q is sectioned or divided in one or more segments s, specifically road segments, wherein each segment s comprises a set length or distance. For example, a segment s may comprise a length or distance of 1000 ft (of course, the segment can have any desired length or distance). The vehicle queue q may comprise one segment or multiple segments s. In an example, at least one segment s is created, wherein the length of the segment s is equal to the vehicle queue q.

In an embodiment, the geometric representation of the vehicle queue q and/or the segment(s) s of the vehicle queue q can be created or loaded using additional data, such as for example geographic information system (GIS) data or derivations of GIS data. For example, GIS data may be interpolated since interpolated GIS data may be more suitable for the described method 400. In embodiments, GIS line-string data, e.g., such as those provided by OpenStreetMaps, Google Maps, HERE, INRIX, are used. Thus, the vehicle traffic data (BSMs 412) can be paired with specific segments of a road. This means that the vehicle traffic data are placed in a specific road segment in accordance with corresponding location data, date/time data and speed data of a respective vehicle (see sub-routine or loop 418).

The geometric representation of the vehicle queue q including the one or more segments s can be created or provided at variable granularities. Thus, a vehicle queue can be detected/determined at variable granularities. For example, as described above, the segments s of the vehicle queue q can be road segments s of actual roads or Highways/Expressways, utilizing GIS data or derivations of GIS data. The vehicle traffic data 210 (data of BSMs 412) is paired with or placed in the specific road segments s, so that vehicle queues can be detected for these road segments s. Further, vehicle queues may not only be determined for road segments s, but for individual lanes of a road segment s. This means that the segments s of a vehicle queue q can be created/provided such that an individual lane of a road or road segment is paired with vehicle traffic data (BSMs 412). Thus, vehicle queues can be identified for a specific lane, for example right lane of an exit of a Highway, or a specific lane approaching an intersection.

At event 416, the extracted BSMs 412 and the geometric representation of the vehicle queue q with segment(s) s are aggregated or combined. The aggregation 416 can be a manual process or an automated process. Following the aggregation 416, a sub-routine or loop 418 is performed. In our example, the loop 418 comprises a time length of one minute, see end of loop 426. Of course, the loop 418 may be performed for more or less than one minute.

As illustrated in FIG. 4A, either all BSMs 412 (about 10 BSMs per second per vehicle) are submitted or provided to aggregation 416, or only a certain number or ratio of the BSMs 412 are submitted and processed. For example, 1 (one) BSM per OBU 200 per second is sampled, see act 413. Considering the large amount of BSMs 412, such selection or sampling of BSMs 412 can speed up the method 400 tremendously. Of course, more than 1 BSM per OBU 200 can be sampled for the process.

By the sub-routine 418, the BSMs 412 are processed and evaluated to find out whether data or information of each BSM 412 can be associated with the vehicle queue q. For each BSM 412, vehicle traffic data, in particular speed, GPS location, date and time of the respective vehicle are used. Based on the location, date and time, it is determined whether the respective vehicle is within the vehicle queue q at a specific time. In particular, it is determined whether the vehicle can be placed within the segment s of the vehicle queue q, for example at the most exact location within the segment s (act 420). If the location data provide that the corresponding vehicle is within the segment s of the vehicle queue q, then a speed value of the specific time is assigned to the segment s (act 422). For example, the speed value can be assigned to an index in segment (s). In act 424, the vehicle queue q is updated based on assigned data, for example assigned speed value(s). During the sub-routine 418, multiple BSMs 412 relating to multiple vehicles are processed and the vehicle queue q updated accordingly.

Once the sub-routine 418 is completed, for example after one minute (see 426), the vehicle queue q, specifically the one or more road segments s of the vehicle queue q, are considered or analyzed. Based on existing observation 428 of the vehicle queue q, the vehicle queue q, more precisely the segment(s) s, is analyzed. In decision block 430, it is evaluated whether the segment s comprises a value or not ("Is s empty?"). If the road segment s does have value(s), e.g. speed value(s), then the vehicle queue q is created as an actual present vehicle queue p (act 432) and a longest sequence from end to start of vehicles, based on the assigned speed values/location, is detected (act 434) and output, for example displayed on a user interface device, see act 436.

If the segment s is empty and does not comprise a value, e.g. speed value, the routine moves to decision block 440. In decision block 440, it is evaluated whether a time-to-live (TTL) of the segment(s) has passed or expired.

Each segment s of the vehicle queue q comprises a (pre-)defined TTL. The TTL defines how long the segment s is active and pending. For example, the TTL can be one minute or five minutes or 10 minutes (of course any desired TTL can be chosen). After the TTL expired, the segment s is not active any longer and is considered invalid. When the TTL of the segment s has passed/expired, the segment s is invalidated, see act 442, and the system/method indicates that the status of the vehicle queue q is unknown, act 444.

If the TTL of the segment s has not expired, but the segment s is without information, e.g. speed values, the routine moves on to sub-routine 450. In an embodiment, the method 400 can be adapted to model/estimate the segment s and estimate speed values/data for the segment s. Such an estimation of speed value(s)/data can be performed based on previous speed data of the segment s (for example based on a previous iteration of sub-routine 418) and/or historical (speed) data of the segment s/vehicle queue q, for example based on historical data of this specific location and time. Using previous/historical information, a present vehicle queue p is created, a longest sequence from end to start of the vehicle queue p detected, and a corresponding change in the vehicle queue q/segment s estimated.

In an embodiment, estimation of the end of the vehicle queue p, including assigning estimated speed values, is implemented utilizing Artificial Intelligence (AI), for example by a machine learning (ML) algorithm or model 460, utilizing for example specific input parameters. For example, based on historical data, it can be established at what times of a day/month/year and at what locations (for example specific Highway exits) vehicle queues form and may cause unsafe or dangerous traffic situations. In an example, it has been shown that at exit 1 of Highway A, every day between 7:00 am and 8:00 am, a vehicle queue of lengths X forms. This data is continually updated using the vehicle traffic data 210 collected by the RSUs 200. The ML algorithm 460 can use this data to estimate the vehicle queue p.

In another embodiment, when a present vehicle queue q is detected, see for example acts 430-436 and sub-routine 450, the system 300/method 400 can be adapted to calculate a length of the vehicle queue p, based for example on the segment(s) s since each segment s comprises a specific length or distance. In another embodiment, the system 300/method 400 is adapted to issue a deceleration warning, the warning being distributed to vehicles when the multiple vehicles approach an end of the vehicle queue p. The system 300, for example the evaluation module 350, may create or provide the warning message. In another example, the system 300, for example evaluation module 350, may create a signal or an action item for another module or system to create the message. For example, such a warning message may be broadcasted by a RSU 200 close to the specific exit or road segment where the vehicle queue p is present. When vehicles with an OBU 100 approach the respective RSU 100, the message is received by the OBU 100 and provided to the driver of the vehicle. The message can be an audio and/or visual message to the driver of the vehicle. In an example, the message can be configured as End of Ramp Deceleration Warning (ERDW). Such a message may be: "Please slow down—approach of a vehicle queue at exit 1 of Highway A". In other embodiments, such an ERDW message or other type of warning message may be transmitted or broadcasted to the vehicles via text messages, for example by short message service (sms) or using other applications, for example web applications, as a pop up. Messages may be received via the OBU 100 of the vehicle or via a smart phone or tablet (or other smart device) with a corresponding application installed to receive such messages.

It should be appreciated that the described method 400 may include additional acts and/or alternative acts corresponding to the features described previously with respect to the system 300 and evaluation module 350 (see FIG. 3).

The described system 300 and method 400 provide an algorithm designed for detecting or determining a vehicle queue length. A new use case for connected vehicle data is described, allowing road authorities to utilize generated data by leveraging connected vehicle infrastructure investments. The approach is designed with minimum data of the Basic Safety Messages, e.g., speed, GPS location, data and time. This preserves user privacy at core while helping to create or support functionalities for safety increase of roads. The described system and method can be used to detect vehicle queue buildup on any stretch of road whether it is connected to a signalized intersection or is a part of freeway.

It should be appreciated that acts associated with the above-described methodologies, features, and functions (other than any described manual acts) may be carried out by one or more data processing systems, such as for example evaluation module 350, via operation of at least one processor 360. As used herein, a processor corresponds to any electronic device that is configured via hardware circuits, software, and/or firmware to process data. For example, processors described herein may correspond to one or more (or a combination) of a microprocessor, CPU, or any other integrated circuit (IC) or other type of circuit that is capable of processing data in a data processing system. As discussed previously, the processor 360 that is described or claimed as being configured to carry out a particular described/claimed process or function may correspond to a CPU that executes computer/processor executable instructions stored in a memory in form of software and/or firmware to carry out such a described/claimed process or function. However, it should also be appreciated that such a processor may correspond to an IC that is hard wired with processing circuitry (e.g., an FPGA or ASIC IC) to carry out such a described/claimed process or function.

In addition, it should also be understood that a processor that is described or claimed as being configured to carry out a particular described/claimed process or function may correspond to the combination of the processor 360 with the executable instructions (e.g., software/firmware apps) loaded/installed into a memory (volatile and/or non-volatile), which are currently being executed and/or are available to be executed by the processor 360 to cause the processor 360 to carry out the described/claimed process or function. Thus, a processor that is powered off or is executing other software, but has the described software installed on a data store in operative connection therewith (such as on a hard drive or SSD) in a manner that is setup to be executed by the processor (when started by a user, hardware and/or other software), may also correspond to the described/claimed processor that is configured to carry out the particular processes and functions described/claimed herein.

Further, it should be understood, that reference to "a processor" may include multiple physical processors or cores that are configured to carry out the functions described herein.

It is also important to note that while the disclosure includes a description in the context of a fully functional system and/or a series of acts, those skilled in the art will appreciate that at least portions of the mechanism of the present disclosure and/or described acts are capable of being distributed in the form of computer/processor executable instructions (e.g., software and/or firmware instructions) contained within a data store that corresponds to a non-transitory machine-usable, computer-usable, or computer-readable medium in any of a variety of forms. The computer/processor executable instructions may include a routine, a sub-routine, programs, applications, modules, libraries, and/or the like. Further, it should be appreciated that computer/processor executable instructions may correspond to and/or may be generated from source code, byte code, runtime code, machine code, assembly language, Java, JavaScript, Python, Julia, C, C #, C++, Scala, R, MATLAB, Clojure, Lua, Go or any other form of code that can be programmed/configured to cause at least one processor to carry out the acts and features described herein. Still further, results of the described/claimed processes or functions may be stored in a computer-readable medium, displayed on a display device, and/or the like.

What is claimed is:

1. A system for determining a vehicle queue length in a connected vehicle infrastructure environment comprising:

a vehicle traffic data evaluation module comprising at least one processor configured via executable instructions to:

receive vehicle traffic data of multiple vehicles, the vehicle traffic data comprising basic safety messages, wherein each basic safety message comprises a standardized set of data including location, speed, date, and time, recorded by the multiple vehicles, create a geometric representation of a vehicle queue, the vehicle queue comprising a plurality of segments, each segment comprising a set length, extract data of speed, location, date and time from the basic safety messages, aggregate extracted data with the geometric representation of the vehicle queue, assign a speed value of a basic safety message of a vehicle to a segment when the vehicle is identified to be located within the segment of the vehicle queue, detect a sequence of segments comprising assigned speed values, and determine a vehicle queue length based on the set length of each segment, wherein each segment of the vehicle queue includes a pre-defined time-to-live (TTL), wherein the TTL defines how long the segment is active and pending.

2. The system of claim 1, wherein the vehicle traffic data evaluation module is configured to issue a deceleration warning to a vehicle, the deceleration warning including information relating to a detected vehicle queue when the vehicle approaches an end of the vehicle queue.

3. The system of claim 1, wherein the vehicle traffic data evaluation module is configured to invalidate the segment when the segment is without an assigned speed value and the TTL has expired.

4. The system of claim 1, wherein the vehicle traffic data evaluation module is configured to estimate and assign a speed value to the segment when, after a defined period, the segment is without an assigned speed value and valid TTL.

5. The system of claim 4, wherein the vehicle traffic data evaluation module is configured to estimate a change of the length of the vehicle queue and to calculate the vehicle queue length based on the estimated change.

6. The system of claim 4, wherein the vehicle traffic data evaluation module comprises a machine learning (ML) algorithm and is configured via executable instructions to estimate the length of the vehicle queue by implementing the machine learning (ML) algorithm utilizing historical data of vehicle queue lengths of a location.

7. The system of claim 1, further comprising:

a plurality of roadside units installed at different locations within a road network, each roadside unit comprising a wireless receiver and configured to collect, via the wireless receiver, the vehicle traffic data from the multiple vehicles travelling in the road network.

8. The system of claim 7, wherein the vehicle traffic data evaluation module is configured to receive the vehicle traffic data from the plurality of roadside units and determine the vehicle queue length in real time.

9. The system of claim 1, wherein the vehicle traffic data comprising the basic safety messages are stored on a storage medium and the vehicle traffic data evaluation module is configured to determine the vehicle queue length on demand.

10. A method for determining a vehicle queue length in a connected vehicle infrastructure environment comprising through operation of at least one processor:

receiving vehicle traffic data of multiple vehicles, the vehicle traffic data comprising basic safety messages, wherein each basic safety message comprises a standardized set of data including location, speed, date, and time, recorded by the multiple vehicles, creating a geometric representation of a vehicle queue, the vehicle queue comprising one or more segments, each segment comprising a set length, extracting data of speed, location, date and time from the basic safety messages, aggregating extracted data with the geometric representation of the vehicle queue, assigning a speed value of a basic safety message of a vehicle to a segment when the vehicle is identified to be located within the segment of the vehicle queue, detecting a sequence of segments comprising assigned speed values, and determining a vehicle queue length based on the set length of each segment, wherein each segment of the vehicle queue comprises a pre-defined time-to-live (TTL), wherein the TTL defines how long the segment is active and pending, and invalidating a segment when the segment is without assigned speed value and the TTL is expired.

11. The method of claim 10, further comprising:

issuing a deceleration warning to a vehicle comprising information relating to a detected vehicle queue when the vehicle approaches an end of the vehicle queue.

12. The method of claim 10, further comprising estimating a speed value of a segment when the segment is without an assigned speed value and the TTL is valid.

13. The method of claim 12, further comprising:

estimating a change of the vehicle queue length and determining the vehicle queue length based on the estimated change.

14. The method of claim 12, wherein the vehicle traffic data evaluation module comprises a machine learning (ML) algorithm and is configured via executable instructions to estimate the length of the vehicle queue by implementing the machine learning (ML) algorithm utilizing historical data of vehicle queue lengths.

15. The method of claim 10, wherein the vehicle traffic data are received in real time from a plurality of roadside units and the vehicle queue length is determined in real time.

16. The method of claim 10, further comprising:

storing the vehicle traffic data comprising the basic safety messages on a storage medium, and determining the vehicle queue length on demand.

17. A non-transitory computer readable medium encoded with processor executable instructions that when executed by at least one processor, cause the at least one processor to carry out a method for determining a vehicle queue length as claimed in claim 10.

18. The system of claim 1, wherein the vehicle queue is determined for individual lanes of a road segment, wherein the segments of the vehicle queue are created such that an individual lane of a road segment is paired with vehicle traffic data, wherein the vehicle queue can be identified for a specific lane of a road segment or a specific lane approaching an intersection.

19. The system of claim 1, wherein the pre-defined time-to-live is between one and 10 minutes.

20. The method of claim 10, wherein the pre-defined time-to-live is between one and 10 minutes.

* * * * *